United States Patent [19]

Locher

[11] Patent Number: 4,787,673

[45] Date of Patent: Nov. 29, 1988

[54] CHAIR SUPPORT WITH ADJUSTMENT DEVICE

[75] Inventor: Hermann Locher, Dornach, Switzerland

[73] Assignee: Giroflex Entwicklungs AG, Koblenz, Switzerland

[21] Appl. No.: 96,334

[22] Filed: Sep. 14, 1987

[30] Foreign Application Priority Data

Sep. 24, 1986 [CH] Switzerland ..... 03843/86

[51] Int. Cl.[4] ..... A47C 3/00; A47C 1/08

[52] U.S. Cl. ..... 297/301; 297/355; 297/361; 74/471 R

[58] Field of Search ..... 297/301, 306, 302, 355, 297/361, 338, 339, 340, 347, 285; 251/213, 251, 231, 234; 137/636.1, 636.3

[56] References Cited

U.S. PATENT DOCUMENTS

| | | | |
|---|---|---|---|
| 3,284,135 | 11/1966 | Hiramatsu | 297/361 |
| 3,807,796 | 4/1974 | Wirges | 297/361 |
| 4,200,332 | 4/1980 | Brauning | 297/355 X |
| 4,408,800 | 10/1983 | Knapp | 297/347 |
| 4,526,055 | 7/1985 | Batchelor | 137/636.2 |

FOREIGN PATENT DOCUMENTS

| | | | |
|---|---|---|---|
| 1363716 | 5/1964 | France | 297/361 |

*Primary Examiner*—James T. McCall

*Attorney, Agent, or Firm*—Werner W. Kleeman

[57] ABSTRACT

The chair support comprises a supporting structure, a seat holder and a backrest holder. The seat holder is connected by means of a first swivel joint with the supporting structure and by means of a second swivel joint with the backrest holder. At an arm or arm structure of the backrest holder extending in a direction towards the front end of the chair support where the seat user's legs will fit, a guide rod or link and the piston rod of a spring element are rotatably mounted by means of a third swivel joint, while at the other end of the chair support, the spring element is mounted by means of a holding bracket at a swivel joint supported in the supporting structure. At the spring element, there is provided an operating slide tappet or plunger for alternately blocking and allowing free movement of the spring element, which is operable by means of an operating or actuating mechanism composed of a rod and a two-armed angle lever mounted in the holding bracket and by means of an adjusting lever. Operatively associated with the adjusting lever is a locking mechanism which makes possible the blocking and free movement of the spring element using just the adjusting lever.

13 Claims, 1 Drawing Sheet

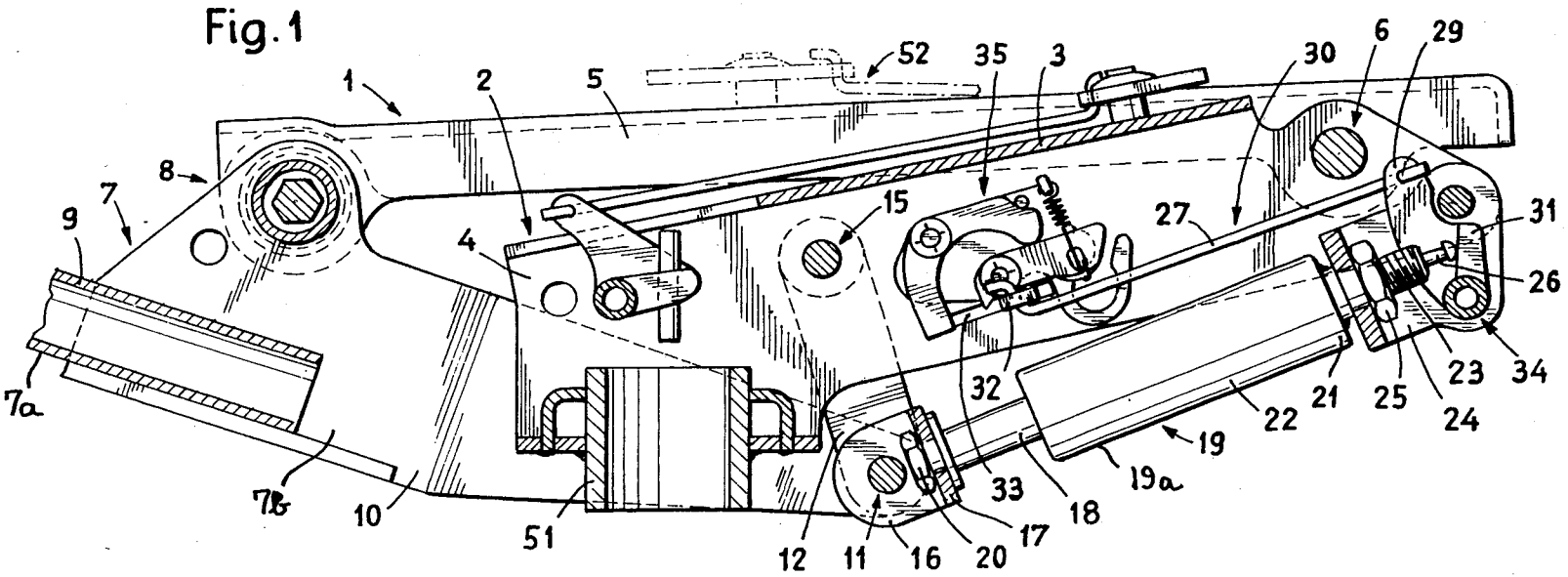
Fig. 1
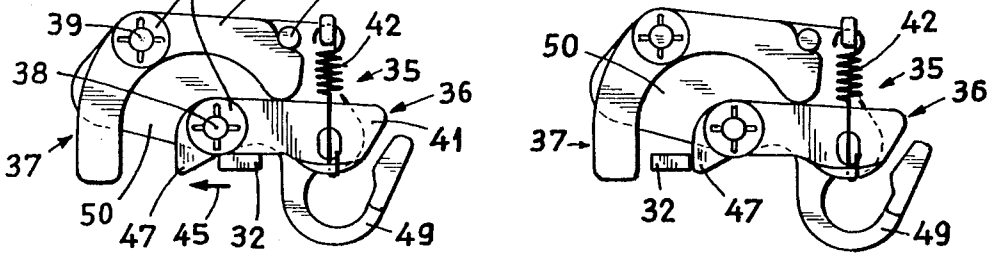
Fig. 2
Fig. 3
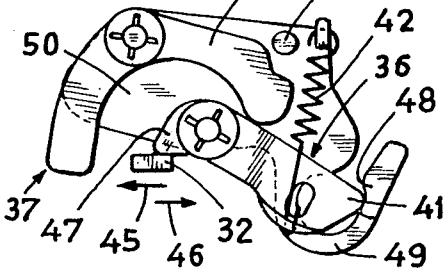
Fig. 4

CHAIR SUPPORT WITH ADJUSTMENT DEVICE

CROSS REFERENCE TO RELATED APPLICATION

This application is related to the commonly assigned, copending U.S. application No. 07/096,333, filed Sept. 14, 1987, and entitled "Chair Support".

BACKGROUND OF THE INVENTION

The present invention relates to a new and improved construction of a chair support or frame structure.

In its more specific aspects, the present invention relates to a new and improved construction of a chair support or chair frame structure for a chair with a seat holder or support and a backrest holder or support. The seat holder or support is connected at least at its front end, where the seat user's legs will fit, with a supporting or support structure forming a part of a foot support or chair base structure and at its backrest end with the backrest holder or support by means of a swivel joint or pivot joint possessing a substantially horizontal axis of rotation. The backrest holder or support possesses an arm or arm structure extending in the direction or the front end of the chair support or chair frame structure. The arm or arm structure is pivoted at its end at the supporting or support structure by means of a further swivel joint or pivot joint possessing a substantially horizontal axis of rotation. Between the front end of the supporting or support structure and the end of the arm or arm structure, there is positioned a spring or resilient element exerting a force on the backrest holder or support. This spring or resilient element is blockable and freely movable by means of an operating or actuating mechanism operated by an adjusting lever.

Chair supports or frame structures for chairs constructed with a backwardly-inclinable backrest holder, are known from various prior art constructions. In the simplest known exemplary form, one end of both the seat holder and the backrest holder is swivelably or hingeably connected in spaced relationship at a supporting structure about a respective horizontal pivot axis or shaft, and the seat holder or part is connected at its other end with the backrest holder by means of a swivel or pivot joint. When the backrest holder is tilted backwards, the backrest holder tilts through a greater pivot or tilt angle than the seat holder or part, and for this purpose one of the swivel or pivot joints is additionally constructed as a sliding joint or one of the swivel or pivot joints is arranged at a bracket mounted at the seat holder.

For the operation of the chair support it is necessary that a spring element, usually a compression spring, be positioned at the supporting or support structure. A force is exerted by the spring element upon the backrest holder or support in opposition to the force exerted by the chair user against the backrest holder. This spring element can be, for example, constructed as a gas spring or as a spiral spring.

In order to increase the seating comfort, it is known to block the compression spring element in a certain position of the backrest holder or support, thereby fixing the position of the backrest holder or support. For this purpose, there is provided at the chair support an adjusting lever connected with an operating linkage or rod system with which the blocking of the spring element and thereby the backrest holder can be undertaken. However, the disadvantage of this prior art construction is that a further adjusting lever is needed to release the blocked spring element, thus requiring an additional expenditure in equipment and attendant increased costs.

SUMMARY OF THE INVENTION

Therefore with the foregoing in mind, it is a primary object of the present invention to provide a new and improved construction of a chair support or frame structure equipped with an adjustment device which is not afflicted with the aforementioned drawbacks and shortcomings of the prior art constructions.

Another and more specific object of the present invention aims at the provision of a new and improved construction of a chair support or frame structure equipped with an adjustment device which allows the blocking of the chair support or frame structure to be undertaken with an adjusting or adjustment lever, by means of which the free movement of the chair support can be established once again.

Yet a further important object of the present invention aims at the provision of a new and improved construction of a chair support or the like which is relatively simple in construction and design, extremely economical to manufacture, highly reliable in operation, not readily subject to breakdown or malfunction, and requires a minimum of maintenance and servicing.

Now in order to implement these and still further objects of the invention which will become more readily apparent as the description proceeds, the chair support or frame structure of the present development is manifested by the features that the operating or actuating mechanism is constructed as an operating linkage or rod system or structure shifting or displacing an operating or actuating slide tappet or plunger of the spring element into a blocking position and into a freely moving position of the spring element. The operating linkage or rod system or structure is equipped with a locking mechanism actuatable or switchable by means of the adjusting lever, whereby both the blocking as well as the free movement of the spring element can be set or adjusted by means of the adjusting lever.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein:

FIG. 1 is a longitudinal sectional view of a chair support or frame structure composed of a seat holder or part, a backrest holder or part and a spring element, whereby the spring element is operable by means of an operating or actuating mechanism equipped with a locking mechanism or device; and FIGS. 2 to 4 are schematic representations of the locking mechanism or device of the operating or actuating mechanism for the spring element depicted in FIG. 1 and specifically wherein:

FIG. 2 illustrates the locking mechanism or device with the adjusting lever in the blocking position of the spring element;

FIG. 3 illustrates the locking mechanism or device with the adjusting lever in the free movement position of the spring element; and FIG. 4 illustrates the locking mechanism or device with the adjusting lever in transition from the free movement position to the blocking position of the spring element.

DETAILED DESCRIPTION OF THE PREFERRED EMBODIMENTS

Describing now the drawings, it is to be understood that to simplify the showing thereof only enough of the structure of the chair support or frame structure 1 has been illustrated therein as needed to enable one skilled in the art to readily understand the underlying principles and concepts of the present invention. Turning now specifically to FIG. 1 of the drawings, the chair support or frame structure 1 illustrated therein by way of example and not limitation, will be seen to comprise a supporting or support structure 2 which is constructed as an essentially U-shaped hollow body opening downward. The supporting or support structure 2 possesses a cover part or portion 3 and two side walls 4, only one of which is, however, conveniently visible in the showing of FIG. 1. At the front end of the supporting or support structure 2, in other words, at the end where the seat user's legs will fit, a seat holder or support 5 is inclinably mounted in each of the side walls (once again only one of the seat holders 5 is conveniently shown in the drawing of FIG. 1) by means of a first swivel or pivot joint 6. This seat holder or support 5 is connected on the opposite side or end with a backrest holder or support 7 by means of a second swivel or pivot joint 8 constructed as a torsion spring. Further details of the arrangement of the seat holder 5 and the related structure have been disclosed in my aforementioned co-pending United States application, entitled "Chair Support", to which reference may be readily had and the disclosure of which is incorporated herein by reference.

The backrest holder or support 7 is constructed as a two-armed lever, wherein one arm **7*a* thereof forms the back part or component 9, of which only a small portion thereof has been illustrated, and the other arm 7*b* of which extends in the direction towards the front end of the chair support or frame structure 1 where the user's knees are positioned and forms a supporting or support lever 10. At the end of this supporting or support lever 10 there is positioned a third swivel or pivot joint 11. At the third swivel or pivot joint 11, a respective guide rod or link 12 is mounted on each side. Each such guide rod or link 12 is, in turn, rotatably mounted in a fourth swivel or pivot joint 15 positioned at the side walls 4**.

At the third swivel or pivot joint 11, a bracket or bracket member 16 is also mounted, at whose web or web member 17 there is fastened one end of a spring or resilient element 19, here constituting a gas spring **19*a*. This one end of the gas spring 19 is here, for example, a piston rod or rod member 18, which is fastened by means of a nut or nut member 20 to the web or web member 17 of the bracket or bracket member 16. At the other end of the spring element 19 defining the gas spring 19*a*, for example at the base or bottom portion 21 of the cylinder 22 of the gas spring 19, there is arranged a threaded bolt or bolt member 23 which serves, on the one hand, to fasten a holding or holder bracket 24 by means of a nut or nut member 25 and, on the other hand, to hold an operating or actuating slide tappet or plunger 26. By means of the operation of this slide tappet or plunger 26, the length of the spring element 19 constructed as the gas spring 19*a* can be changed as a result of the movement of the backrest holder or support 7 and the supporting or support lever 10, whereby the inclination of the chair support or frame structure 1 is changed. When the operating slide tappet or plunger 26 is in its normal position, the spring element 19 is blocked and the momentarily adjusted or set position of the chair support or frame structure 1** cannot be changed.

An actuating mechanism comprising an operating or actuating linkage or rod system or structure 30 serves to operate the operating slide tappet or plunger 26. The operating linkage or rod system or structure 30 is operable by means of an adjusting lever or lever member 32 slideably or displaceably guided in a guide slot 33 arranged in the side walls 4. The operating linkage or rod system or structure 30 comprises a rod or rod member 27 and a double-armed or two-armed angle lever 34 whose one arm 29 is connected with the rod or rod member 27, while the other arm 31 is in operative connection or association with the operating slide tappet or plunger 26.

In addition, a locking device or mechanism 35, whose operation will be explained in greater detail hereinafter with the aid of FIGS. 2 to 4, is operatively associated with the adjusting lever 32 and the operating linkage or rod system or structure 30 defining the actuating mechanism.

The locking device or mechanism 35 essentially comprises two double-armed or two-armed rocking levers 36, 37, of which one rocking lever 36 constitutes a pawl or latch member acted upon by a spring 42, while the other rocking lever 37 constitutes a release lever. The swivel or pivot axles or shafts 38, 39 of the rocking levers 36, 37, respectively, are constituted by journals or pins arranged on a holding plate or plate member 50, on which the rocking levers 36, 37 are fitted and secured by means of a safety or securing spring 40 or equivalent structure. At one arm 41 of the rocking lever 36, there is connected the spiral spring 42 which pulls the arm 41 towards an arm 43 of the release lever 37, until the release lever 37 rests against a stop or stop member 44. The holding plate or plate member 50 can be formed of any suitable plastic or metal.

If the adjusting lever or lever member 32 is disposed in the position depicted in FIG. 2, the arm 31 of the double-armed or two-armed angle lever 34 interacting with the operating slide tappet or plunger 26 is located in the position which does not actuate the operating slide tappet or plunger 26, so that the spring element 19 is blocked. If the spring element 19 is to be freely movable, the adjusting lever 32 must be shifted in the direction indicated by the arrow 45 in FIG. 2. If the adjusting or adjustment lever 32 is shifted far enough in this direction 45, it runs over a cam or cam member 47 of the rocking lever 36 until it reaches the position depicted in FIG. 3. The adjusting lever 32 is locked in this position and the operating slide tappet or plunger 26 is pressed down and located in the free movement position of the spring element 19. The chair support or frame structure 1 can be pivoted in this position without the need for engaging or operating the adjusting lever 32.

Now if the spring element 19 is to be blocked again, the adjusting lever 32 is shifted further in the direction 45, whereby the release lever 37 is swiveled or pivoted to such an extent that its arm 43 pivots the arm 41 of the pawl or latch 36 into the position shown in FIG. 4, in which the pawl or latch 36 is held by means of a stop cam or cam member 48 positioned at a holding or holder bracket 49. In this position, the adjusting lever 32 is released and is displaced in the opposite direction 46 by means of the restoring force of the operating or actuating slide tappet or plunger 26. As a result, the adjusting lever 32 pushes on the arm 41 of the pawl or latch 36 until the pawl or latch 36 is released from engagement with the stop cam or cam member 48 and lifted by means of the spiral spring 42 or equivalent structure into the initial starting position. The two rocking levers 36, 37 and the adjusting lever 32 then again assume the position represented in FIG. 2.

The holding or holder bracket 49 can be positioned on the plate 50 or also mounted as a separate piece. This holding or holder bracket 49 should possess a sufficient elasticity, so that the arm or arm member 41 of the pawl or latch 36 can be held at the stop cam or cam member 48 and then released again.

At the supporting or support structure 2 there is attached a tube support 51 which is intended to act together with the foot support or base structure of the chair (not illustrated). Since a further conventional spring element (not illustrated) is needed in the foot support or base structure for the height adjustment of the chair, an appropriate operating linkage or rod system or structure 52 is also provided. The operation of this linkage or rod system or structure, which is not relevant to the present invention or the understanding of the principles thereof, is, however, fully described in the aforementioned commonly assigned, co-pending United States Application, to which reference may be readily had and the disclosure of which is incorporated herein by reference.

The use of the locking device or mechanism 35 is not restricted or limited to chair supports or frame structures as depicted in FIG. 1, but can also be used for other chair supports or frame structures where at least the backrest holder or support is reclinable or inclinable. In this case, the guide rods or links 12 are discarded and the spring element 19 can be arranged in the manner shown in FIG. 1, for example as a traction or tension spring. The locking device or mechanism 35 is hereby always operatively associated with the adjusting or adjustment lever 32.

While there are shown and described present preferred embodiments of the invention, it is to be distinctly understood that the invention is not limited thereto, but may be otherwise variously embodied and practiced within the scope of the following claims.

Accordingly, what I claim is:

1. A chair support for a chair, comprising:

a seat holder having a front end and a backrest end;

a backrest holder;

a supporting structure having a front end and forming a part of a foot support for the chair;

means for connecting said seat holder at least at its front end with said supporting structure;

means defining a swivel joint possessing a substantially horizontal axis of rotation for connecting said seat holder at its backrest end with said backrest holder;

an arm structure having an end region and connected with said backrest holder;

said arm structure extending in a direction towards the front end of the seat holder;

means defining a further swivel joint possessing a substantially horizontal axis of rotation and positioned at the end region of said arm structure;

a spring element exerting a force on said backrest holder;

said spring element being positioned between the front end of said supporting structure and the end region of said arm structure;

an actuating mechanism;

an adjusting lever for operating said actuating mechanism;

said spring element being blockable and freely movable by means of said actuating mechanism operated by said adjusting lever;

said spring element including an operating slide tappet;

said actuating mechanism being constructed as an operating rod system displacing said operating slide tappet of said spring element into a blocking position and into a freely moving position of the spring element;

a locking mechanism operatable by said adjusting lever and provided for said operating rod system; and said adjusting lever serving to adjust blocking and freeing movement of said spring element.

2. The chair support as defined in claim 1, wherein:

said supporting structure includes wall means;

said adjusting lever being guided in said wall means of said supporting structure;

said locking mechanism comprising a pair of two-armed rocking levers;

each of said two-armed rocking levers having a respective end;

said ends of said pair of two-armed rocking levers of said locking mechanism projecting into the region of said supporting structure;

a spring;

one of said two-armed rocking levers defining a pawl acted upon by said spring;

said adjusting lever holding said operating slide tappet in the freely moving position of said spring element by means of said pawl;

the remaining one of said two-armed rocking levers defining a release lever; and said pawl can be pivoted into a position releasing said adjusting lever by deflecting said release lever by means of said adjusting lever.

3. The chair support as defined in claim 2, further including:

a holding bracket;

a stop cam provided for the holding bracket; and said pawl being held in a position releasing said adjusting lever by means of said holding bracket provided with said stop cam.

4. The chair support as defined in claim 3, further including:

a holding plate;

means for rotatably mounting said pawl and said release lever on said holding plate;

a stop provided for said release lever;

fastening means provided for said spring;

said fastening means being arranged on the holding plate; and said holding bracket with said stop cam being fastened on said holding plate.

5. The chair support as defined in claim 1, wherein:

said holding plate is formed of plastic.

6. The chair support as defined in claim 1, wherein:

said holding plate is formed of metal.

7. The chair support as defined in claim 3, further including:

a holding plate; and means for rotatably mounting said pawl and said release lever on said holding plate;

a stop provided for said release lever;

fastening means provided for said spring;

said fastening means being arranged on the holding plate; and said holding bracket with said stop cam forming a part of said holding plate.

8. The chair support as defined in claim 7, wherein:

said holding plate is formed of plastic.

9. The chair support as defined in claim 7, wherein:

said holding plate is formed of metal.

10. The chair support as defined in claim 4, wherein:

said supporting structure comprising wall means;

said adjusting lever is provided with a guide slot at said wall means; and said holding plate being positioned at said wall means of said supporting structure directly over said guide slot of said adjusting lever.

11. The chair support as defined in claim 1, wherein:

said operating rod system comprises a rod and a two-armed angle lever;

one arm of said two-armed angle lever being connected with said rod; and the remaining arm of said two-armed angle lever being operatively connected with said operating slide tappet.

12. The chair support as defined in claim 11, further including:

a holding bracket fastened at said spring element;

means for pivotably mounting said two-armed angle lever in said holding bracket fastened at said spring element; and means for pivotably mounting said holding bracket at the front end of said supporting structure.

13. A chair support for a chair, comprising:

a seat holder having a front end and a backrest end;

a backrest holder;

a supporting structure having a front end;

means for pivotably connecting said seat holder at least at its front end with said front end of said supporting structure;

means for pivotably connecting said seat holder at its backrest end with said backrest holder;

an arm structure having an end region and coacting with said backrest holder;

said arm structure extending in a direction towards the front end of the seat holder;

means defining a swivel joint positioned at the end region of said arm structure;

spring means exerting a force on said backrest holder;

said spring means being positioned between the front end of said supporting structure and the end region of said arm structure;

an actuating mechanism;

an adjusting means for operating said actuating mechanism;

said spring means being blockable and freely movable by means of said actuating mechanism operated by said adjusting means;

said spring means including an operating means;

said actuating mechanism comprising an operating system displacing said operating means of said spring means into a blocking position and into a freely moving position of the spring means;

locking means selectively actuatable by said adjusting means and provided for said operating system; and said adjusting means serving to selectively undertake blocking of said spring means and freeing movement of said spring means.

* * * * *